US005821490A

United States Patent [19]

Blossfeld

[11] Patent Number: 5,821,490

[45] Date of Patent: Oct. 13, 1998

[54] PUSH BUTTON SWITCH MODULE

[75] Inventor: Michael Blossfeld, Pinckney, Mich.

[73] Assignee: Yazaki Corporation, Tokyo, Japan

[21] Appl. No.: 690,285

[22] Filed: Jul. 26, 1996

[51] Int. Cl.[6] ..... H01H 3/42

[52] U.S. Cl. ..... 200/524; 200/530; 200/531; 200/523

[58] Field of Search ..... 200/524, 523, 200/530, 531, 532, 536, 257

[56] References Cited

U.S. PATENT DOCUMENTS

| | | | |
|---|---|---|---|
| 3,204,069 | 8/1965 | West | 200/531 |
| 4,404,444 | 9/1983 | Kinney et al. | 200/524 |
| 4,467,160 | 8/1984 | Murmann et al. | 200/536 |
| 4,497,983 | 2/1985 | Galloway et al. | 200/531 |
| 4,891,475 | 1/1990 | Wiersing et al. | 200/524 |
| 4,937,409 | 6/1990 | Hayashi | 200/524 |
| 5,380,970 | 1/1995 | Mizuno et al. | 200/523 |
| 5,528,007 | 6/1996 | Williams et al. | 200/16 |
| 5,532,444 | 7/1996 | Bonrath et al. | 200/524 |
| 5,539,169 | 7/1996 | Sekita | 200/524 |
| 5,545,862 | 8/1996 | Takano et al. | 200/16 |
| 5,545,864 | 8/1996 | Bauer et al. | 200/283 |
| 5,545,865 | 8/1996 | Gotou | 200/341 |
| 5,546,288 | 8/1996 | Van Order et al. | 362/74 |

*Primary Examiner*—David J. Walczak
*Attorney, Agent, or Firm*—Young & Basile, P.C.

[57] ABSTRACT

A switch module for connection to an electrical circuit comprises a manually actuated ON/OFF switch mechanism mounted on a molded plastic case and two or more bus bars built integrally into the structure of the case, as by an insert molding process. The bus bars project out of the case at their ends, the exposed ends serving as terminals for electrical connection with the circuit and as spring contacts within the switch mechanism. The push button switch mechanism is an improvement over prior switches, having a single spring controlling both the push button and the shorting bar, and having positive alignment of the shorting bar and bus bar ends achieved by the pre-positioning of the bus bar ends in direct lateral sliding contact with the push button sidewall and sidewall-mounted shorting bar.

14 Claims, 4 Drawing Sheets

FIG-2
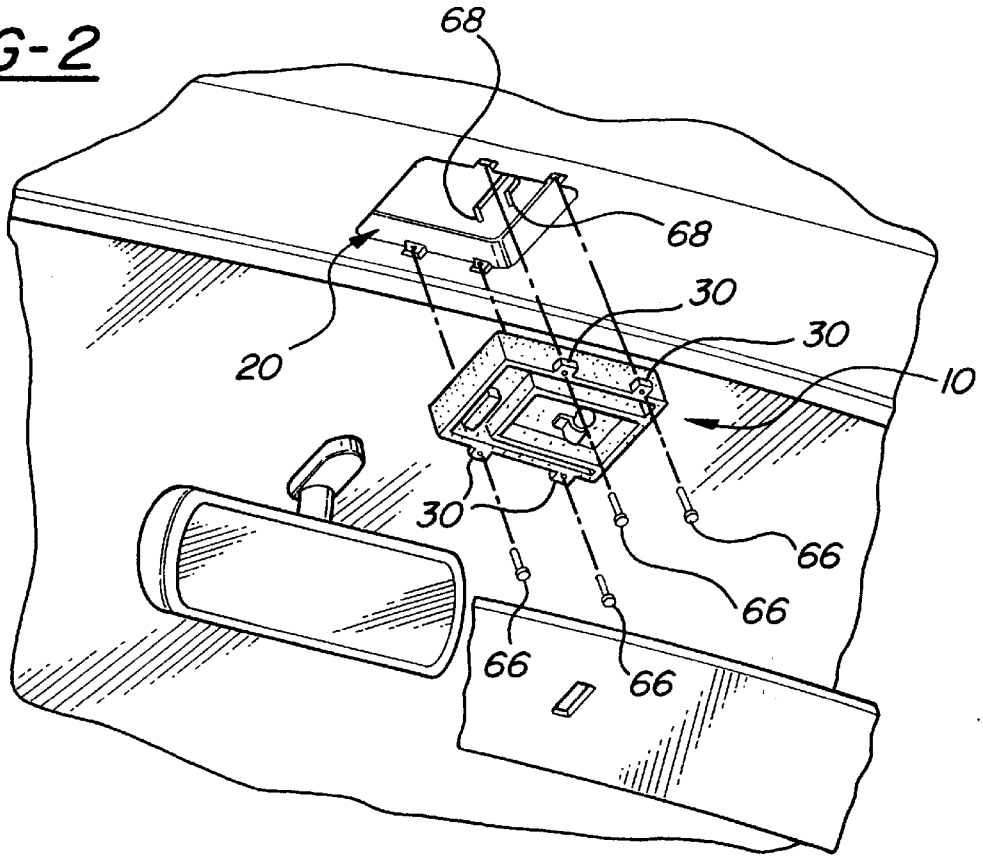
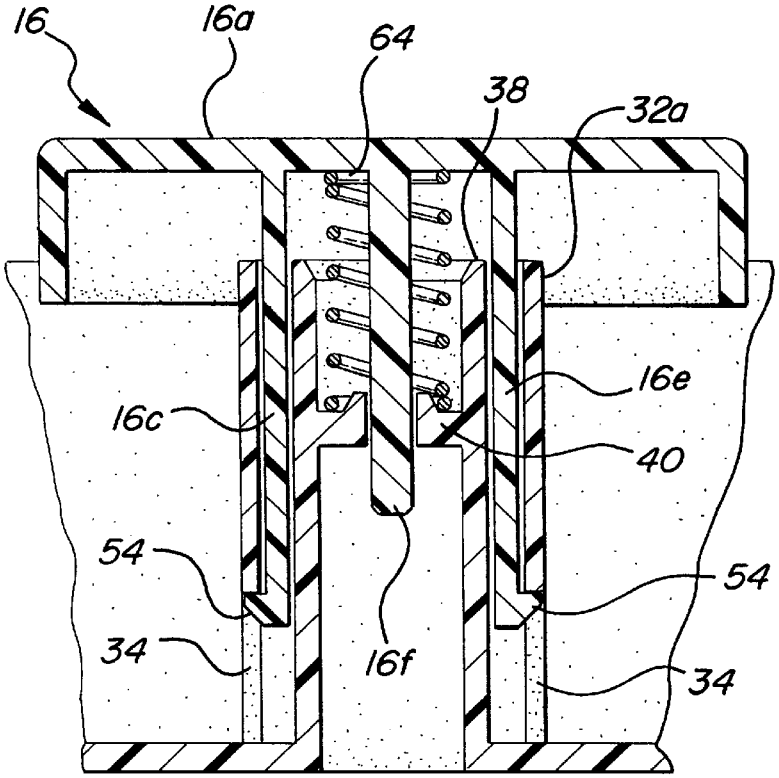
FIG-5

PUSH BUTTON SWITCH MODULE

FIELD OF THE INVENTION

This invention relates to a push button switch module for an electrical circuit of the type used in small electrical fixtures, for example automobile dome lights. More particularly the invention relates to such a switch module having integrally molded bus bar conductors and an improved push button switch mechanism.

BACKGROUND OF THE INVENTION

The term "push button switch" as used herein refers to a two-position, ON/OFF switch mechanism where a first press of the push button actuates the switch from OFF to ON, and a second press of the push button turns the switch back OFF. Generally, such switch mechanisms include two springs: a stronger release spring which urges the push button to a raised position corresponding to OFF; and a weaker connect spring for holding a movable contact axially against a circuit contact in the ON condition. When the button is pressed down against the release spring force, the contact is moved to a closed position against the circuit contact to complete the circuit, and a latching mechanism engages the button to hold the push button down in the ON position when the button is released. A subsequent press of the push button disengages the latch so that the release spring can return the button to its raised OFF position. These switch mechanisms also use an umbrella-like rubber contact around the movable contact to isolate it from the fixed contact when the connect spring is released. Such switches are appropriate for use in many different electrical circuit applications, and are commonly used in automotive vehicles to control electrical devices such as dome lights in the passenger compartment or rear window defoggers.

U.S. Pat. No. 5,380,970 (co-owned with the present application by Yazaki Corporation) discloses both a prior art switch as described above, and an improved push button switch mechanism in which the push button is retained in a guide chamber formed on a housing, the housing containing a printed circuit board with a fixed electrical contact on its upper surface. The push button has a hollow lower end with an internal sliding sleeve, the sleeve carrying an electrical contact. When the push button is pressed down into the guide chamber, the sleeve is carried down until the sleeve-mounted contact meets with the fixed contact on the circuit board to close a circuit. Latching is accomplished with a heart-shaped cam groove formed in the push button and a pin engaging the cam groove to latch the push button in the switch-closed position until the button is pressed down a second time, whereupon the latching engagement between the cam groove and the pin is released. The '970 switch mechanism also requires two springs, a stronger axial release spring and a weaker axial connect spring, one to bias the push button upwardly with respect to the guide chamber and the other to bias the sleeve downwardly with respect to the push button to hold the movable contact axially against the fixed contact. The relative spring rates of the two springs must be balanced for proper switch operation. The '970 switch also requires a rubber contact to isolate the movable contact from the fixed contact.

The switch mechanism in the '970 patent "accommodates a circuit board 13 including a fixed contact 12" (column 3, lines 38–41). The switch is a separate assembly which must be added to and aligned with the circuit board and its contact. The use of the printed circuit board as a support for the fixed contact also adds to the expense of the switch in the '970 patent by virtue of both the cost of producing the circuit board and of the additional steps required to assemble the board to the switch. Additionally, the '970 switch does not make any provision for the physical mounting or installation of the switch in an operative environment.

BRIEF SUMMARY OF THE INVENTION

The present invention is directed toward providing a simplified switch module fabricated from a small number of simple, relatively inexpensive parts and which, after assembly, may be plugged as a pre-assembled unit into connection with an electrical power system to serve as fixture, circuit and ON/OFF circuit-controlling switch all in one. This is generally achieved with a molded housing having integrally-formed switch housing bus bars defining the circuit, the fixture and switch terminals; a push button with a shorting bar to selectively connect or "short" the bus bars, and a latch mechanism for the button.

The invention further comprises an improved push button switch mechanism with a single axial compression spring in the housing acting on the push button to force it away from the housing to an OFF position, and a latching mechanism in the housing to selectively latch the push button in the ON state when the button is pushed and released. The push button itself carries a contact or "shorting bar" for side-mounted sliding contact with the fixed switch terminal contacts connected to the circuit board bus bars. This mechanism reduces the number of push button springs from two to one, and further simplifies the moving contact or "shorting bar" by eliminating the need for a deformable rubber piece to isolate the moving contact from the fixed bus bar contact in the OFF position. Rather than having the shorting bar spring-loaded for contact force as is often the case, fixed spring contacts on the bus bars provide the contact force. This eliminates the need for separate springs within the push button assembly.

The molded housing is preferably formed with a plurality of electrically conductive bus bars insert-molded into the structure of the housing. The ends of the bus bars project from the molded main housing into the integrally-molded switch housing to provide fixed contacts which can be shorted by the moving contact on the push button to close the circuit and turn the powered accessory (e.g. a dome light bulb) ON. Molding the bus bars integrally with the housing results in a reduction in the number of parts that must be assembled to form the switch module, and the completed module constitutes a unitary component that is conveniently installed in its operative environment. The terminal ends of the bus bars plug into mating power terminals to connect the switch module with its power source.

Another feature of the invention is the integrally molded switch housing, which contains the push button switch mechanism and the fixed contact ends of the bus bars. Molding the switch housing integrally with the main housing provides cost advantages in manufacturing of the switch module, and further provides consistently accurate positioning of the bus bar fixed contact ends and the moving contact on the push button.

In a preferred embodiment of the inventive switch module described herein, the bus bars project out of their enclosed positions within the main housing at points intermediate the fixed switch contact ends and the power terminal ends to provide means for mounting a powered accessory such as a light bulb. In this way the module constitutes a unitary light fixture usable, for example, as a plug-in fixture in an automobile. When installed in the vehicle, the terminal ends of the bus bars plug into mating electrical terminals to supply current to the fixture.

BRIEF DESCRIPTION OF THE DRAWINGS

FIG. 2 is a perspective view of the interior of an automobile with the switch module of FIG. 1 in an exploded view with respect to its installed position;

FIG. 5 is a partial cross-sectional view taken along line 5—5 in FIG. 4, with the switch in the OFF position.

DETAILED DESCRIPTION OF THE PREFERRED EMBODIMENT

Figure 1:
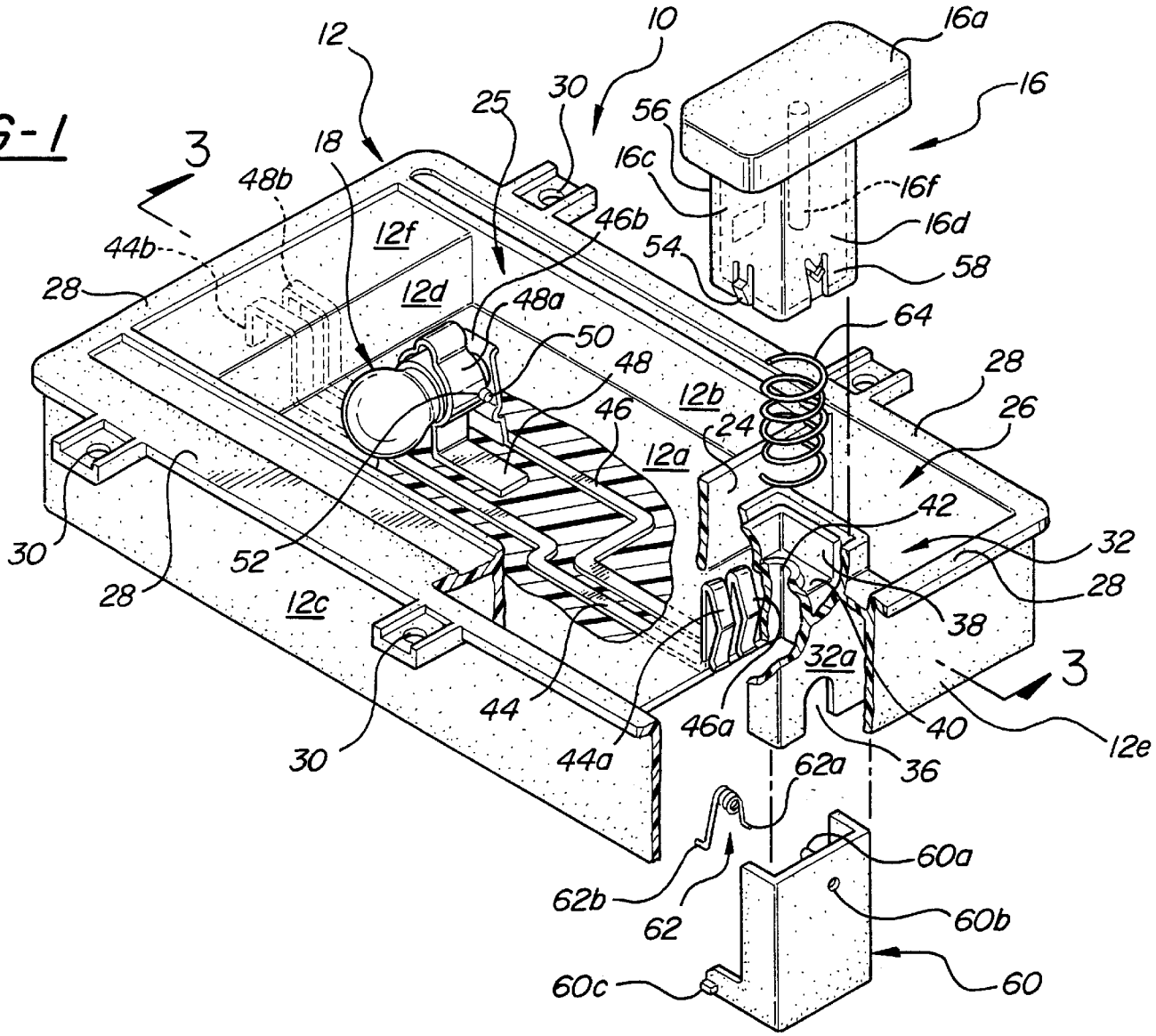
FIG. 1 is a partially exploded perspective view of a switch module according to the present invention for use as a dome light fixture.

FIG. 1 depicts a switch module 10 according to the present invention comprising a molded plastic housing or case 12, a switch mechanism including a push button 16, and a powered fixture 18, for example a light bulb. The illustrative embodiment of the switch module shown in FIG. 1 is adapted to be mounted in an overhead receptacle 20 within the interior of an automobile or other vehicle, as shown in FIG. 2, and when connected to the vehicle electrical power system and fitted with a translucent cover (not shown) it serves as a dome light.

Case 12 is molded of a dielectric plastic material and is generally rectangular in shape, having a lower panel 12*a*, side panels 12*b*, 12*c*, end panels 12*d*, 12*e*, and an upper panel 12*f*. An interior wall 24 divides case 12 into a bulb well 25 and a switch well 26, and a mounting flange 28 projects outwardly from the upper edges of side panels 12*b*–*c*. Four mounting holes 30 in flange 28 permit the switch module to be secured in its operative position within the vehicle interior with screws or bolts.

Figure 3:
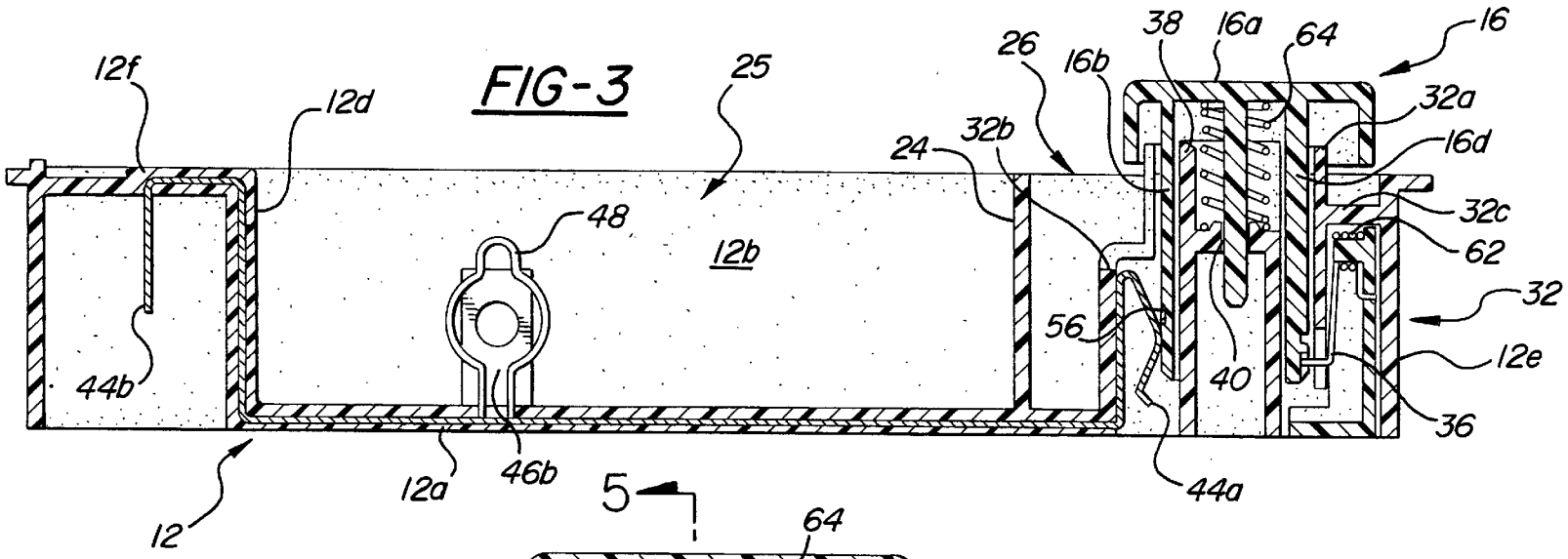
FIG. 3 is a cross-sectional view taken along line 3—3 in FIG. 1, with the switch in the OFF position.

A switch housing 32 is molded integrally with case 12 in switch well 26, extending upwardly from lower panel 12*a*. Switch housing 32 comprises a centrally located rectangular guide chamber 32*a* open at its upper end, a contact chamber 32*b* (FIGS. 3–4) which swells outwardly from the side of the guide chamber facing interior case wall 24, and an opposite latch chamber 32*c* located between the guide chamber and end panel 12*e* of case 12. Cut-outs 34 (FIG. 5) are formed in opposite sides of guide chamber 32*a* adjacent lower panel 12*a*, and a semi-circular spring notch 36 is formed in the sidewall of the guide chamber facing latch chamber 32*c*.

A rectangular inner push button guide 38 is located coaxially in guide chamber 32*a*. Inner push button guide 38 is largely hollow, except for a spring seat 40 across its upper half, the spring seat having a circular hole and bushing 42 formed through its center.

Three electrically conductive bus bars 44, 46, and 48 are molded into casing panels 12*a*, 12*d* and 12*f*, as by an insert molding process, and are exposed only at their ends and where they form an electrical bulb fixture. Bus bar 44 has a first end bent to form a fixed spring contact 44*a* projecting laterally into contact chamber 32*b*, and a second end on the opposite end of case 12 bent downwardly to form a blade terminal 44*b*. Bus bar 46 has a first end bent into a fixed spring contact 46*a* in contact chamber 32*b*, and a second end forming a flat bulb contact tab 46*b* in bulb well 25. Bus bar 48 has a first end forming a downward blade terminal 48*b* next to blade terminal 44*b*, and a second end forming a bulb contact hoop 48*a* in bulb well 25. It would be advantageous to have the three bus bars 44, 46 and 48 formed from single stock and insert molded as one piece into the panels. The bus bars would be separated after the molding process.

Light bulb 18 is a conventional automotive lamp and is placed in operative connection with the switch module by inserting the base of the bulb through bulb contact hoop 48*a* and against bulb contact tab 46*b*. Lock nubs 50 extend from opposite sides of the bulb base and engage notches 52 in bulb contact hoop 48*a* to retain the bulb in position.

Push button 16 in switch housing 32 has a flat top surface 16*a* and a hollow rectangular body formed by four side walls 16*b*–*e*. A guide post 16*f* extends downwardly from the underside of the top surface 16*a* into the hollow body of push button 16. Retention tabs 54 project outwardly from the lower ends of sidewalls 16*c*, 16*e*. A shorting bar 56 is mounted on sidewall 16*b* essentially flush with the sidewall surface, and is made of an electrically conductive material. A heart-shaped cam mechanism 58 is formed in opposite sidewall 16*d*.

A generally L-shaped latch spring insert 60 fits into latch chamber 32*c* and has a lateral spring post 60*a* on its upper end and a pinhole 60*b* penetrating its sidewall adjacent post 60*a*. Post 60*a* and pinhole 60*b* support a torsion latch spring 62. Opposite ends of latch spring 62 are bent at right angles to form a short retention pin 62*a* and a longer latch pin 62*b*. Retention pin 62*a* is held in pinhole 60*b*, and the coiled spring body is mounted on post 60*a*.

Figure 4:
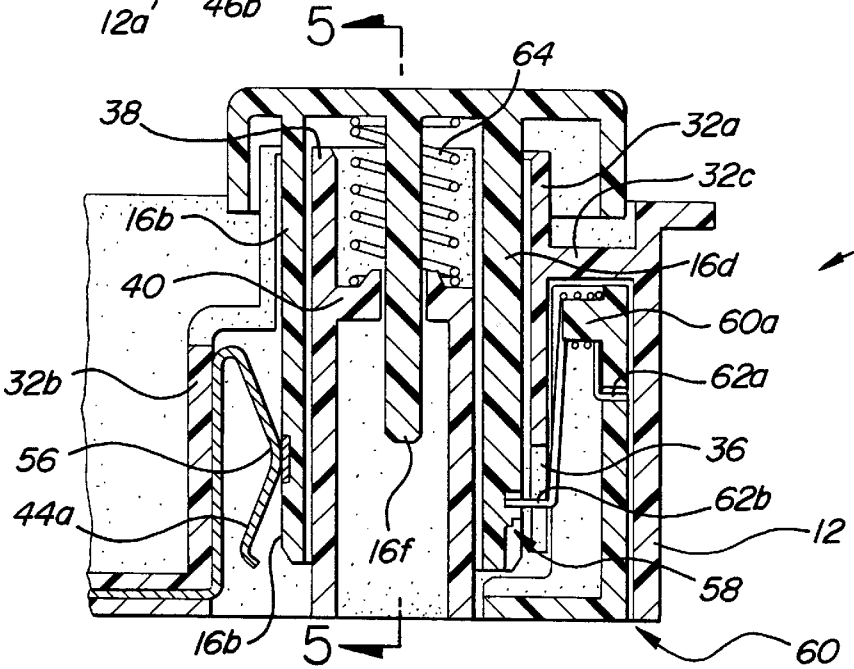
FIG. 4 is an enlarged partial cross-sectional view taken along line 3—3 in FIG. 1, with the switch in the ON position.
Figure 6:
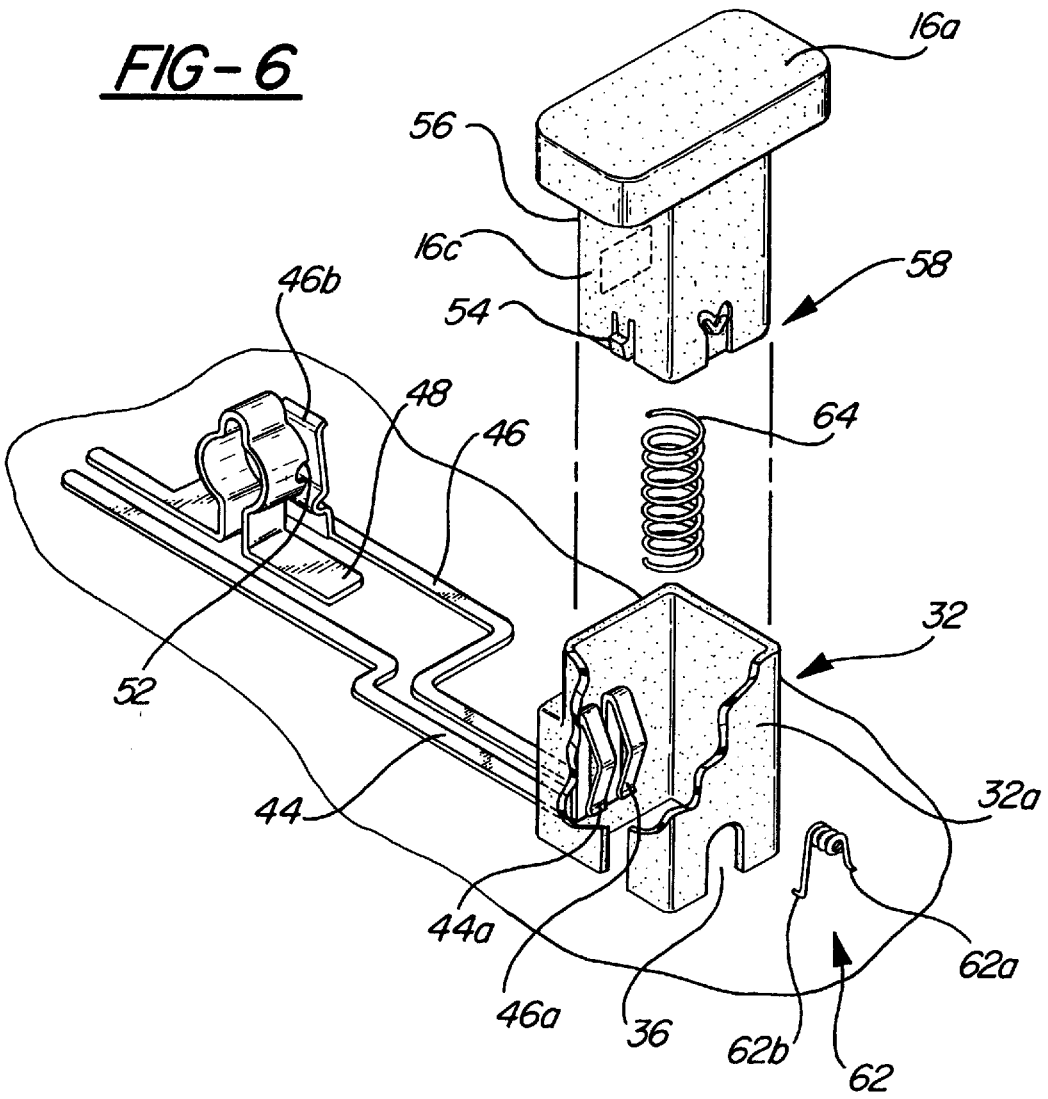
FIG. 6 is a simplified perspective view of the switch module shown in FIG. 1.

As best seen in FIGS. 4 and 6, latch insert 60, with latch spring 62 attached, fits into latch housing 32*c* so that latch pin 62*b* extends through the radius center of the semicircular upper end of spring notch 36 into guide chamber 32*a* . Latch insert 60 is inserted upwardly into the housing through an opening in lower panel 12*a* , and detent tabs 60*c* (see FIG. 1) extend outwardly from the latch insert and snap over cooperating surfaces to retain the latch insert in place.

Push button 16 is retained for sliding movement in switch housing 32, with push button side walls 16*b*–*e* sliding between the walls of guide chamber 32*a* and inner push button guide 38, while push button post 16*f* reciprocates through hole and bushing 42 in spring seat 40. Push button retention tabs 54 snap into engagement with cut-outs 34 in the lower side walls of guide chamber 32*a* so that they can slide up and down in the cutouts while retaining push button 16 in switch housing 32. Push button spring 64 is held in the guide chamber between the underside of push button top surface 16*a* and spring seat 40 to bias the push button upwardly. Latch pin 62*b* of torsion spring 62 engages cam mechanism 58 in sidewall 16*d* of the push button.

Switch module 10 is turned ON and OFF by successively pressing button 16. Spring 64 biases push button 16 toward the full up position corresponding to the OFF condition (FIG. 3) of switch mechanism 10. In the OFF condition the push button sidewall stays in contact with the bus bar contacts 44*a* and 46*a*, while shorting bar 56 is positioned above spring contacts 44*a* and 46*a* to open the circuit between bus bars 44 and 46 and turn light bulb 18 off. To switch the unit ON push button 16 is pressed against the force of spring 64 to bring shorting bar 56 into circuit-closing contact with bus bar contacts 44*a* and 46*a*. When switch mechanism 10 reaches the ON position (FIG. 4), pin

62*b* engages cam mechanism 58 to latch push button 16 in the ON position even after pressure on the button is released. The configuration of cam mechanism 58 and its interaction with latch pin 62*b* is described and depicted in detail in U.S. Pat. No. 5,380,970, the disclosure of which is incorporated herein by reference.

To return switch mechanism 10 to the OFF position, push button 16 is again pressed against spring 64. A small amount of downward travel releases the latching engagement between pin 62*b* and cam mechanism 58 so that when downward force on the push button 16 is terminated, spring 64 returns the push button to its fully extended position (FIGS. 3 and 5) corresponding to the OFF condition.

The improved switch module and switch mechanism of the present invention result in a simplified, reliable plug-in type electrical fixture with push button operation. The simplified unitary view of FIG. 6 best shows the simplified interrelationship of the modular bus bars, switch and switch housing. By placing the terminal shorting ends of the relevant bus bars in operative engagement with the push button sidewall in the switch housing (FIG. 3), and further by virtue of their being integrally molded into the switch module housing itself, the terminal ends are pre-positioned for sure contact with the shorting bar on the push button. The close-fitting guide chamber, push button switch sidewall and switch housing further ensure consistent, reliable contact between the button-mounted shorting bar and the bus bar ends in the contact chamber portion of the switch housing. The lateral spring-contact of the bus bar terminal ends with the sidewall-mounted shorting bar eliminates the need for a second connect spring to maintain the shorting bar in contact with the bus bar terminal ends and for the associated isolating structure such as the rubber contact of the prior art. Instead, the push button latch mechanism serves double duty in holding the push button ON and in maintaining the shorting bar against the bus bar terminal ends.

As indicated in FIG. 2, switch module 10 is operatively installed in overhead receptacle 20 in the head liner of an automobile by means of fasteners 66 which pass through mounting holes 30. When so installed, terminals 44*b*, 48*b* connect with electrical terminals 68 which are provided in the receptacle and are connected to the automobile's electrical system. Other interior trim panels (not shown) may be positioned around switch module 10 to partially cover the case to provide a desired aesthetic appearance.

It is apparent from the above description that the present invention provides a push button switch module that is inexpensively and easily assembled, and that the module is conveniently installed in an operating environment by virtue of its being a pre-assembled unitary component.

Whereas a preferred embodiment of the invention has been illustrated and described in detail, various changes can be made in the disclosed embodiment without departing from the scope or spirit of the invention as defined in the following claims.

What is claimed is:

1. An improved push button switch mechanism for use in a switch module case with fixed circuit-closing contacts, the switch mechanism operating in push-push fashion between ON and OFF states to selectively short the fixed contacts and close the circuit, the switch mechanism comprising:

a switch housing adapted to be molded integrally with the case;

push button guide means in the switch housing;

a contact chamber in the switch housing on a first side of the guide means, the contact chamber containing the fixed contacts;

a latch chamber in the switch housing on a second side of the guide means, the latch chamber including a latch mechanism;

a push button switch mounted for axial movement on the guide means, the switch having a first sidewall extending into the contact chamber and having a shorting bar contact on the first sidewall positioned to short the fixed contacts when the push button is pressed downwardly to an ON position and to be out of electrical contact with the fixed contacts when the push button is in an OFF position, and a second sidewall extending into the latch chamber and having a cam mechanism engaging a latch portion of the latch mechanism to latch the push button in the ON position on a first press and unlatch the push button on a successive press; and a single axial spring associated with the guide means and acting against the push button to force the unlatched push button and the shorting bar contact to the OFF position.

2. The push button switch mechanism of claim 1, wherein the first sidewall of the push button is arranged to be in contact with the fixed contacts in the OFF position.

3. The push button switch mechanism of claim 2, wherein the fixed contacts comprise two laterally spaced contacts of identical height relative to the shorting bar contact.

4. The push button switch mechanism of claim 2, wherein the fixed contacts include spring contact portions under a lateral bias against the first sidewall of the push button.

5. An improved plug-in type switch module containing an electrical fixture connected to receive power from the circuit, and a push button switch mechanism for selectively closing the circuit, comprising:

a housing with three bus bars defining the circuit and the electrical fixture, first and second of the bus bars having terminal plug-in ends extending beyond the housing for connection to an external power source, the first and third bus bars having switch contact ends located in the housing near the switch mechanism, and the second and third bus bars having fixture contact ends for connection to the electrical fixture, the bus bars being insert molded into the housing such that only the terminal plug-in ends, the switch contact ends and the fixture contact ends are exposed;

a hollow switch housing molded integrally with the housing, the switch housing containing a central guide chamber, the switch housing and central guide chamber defining therebetween a contact chamber in the switch housing containing the switch contact ends of the first and third bus bars, and a latch chamber containing a latch mechanism;

a push button switch mounted for axial movement on the guide chamber, and a single axial spring located in the guide chamber to bias the push button switch away from the housing to an OFF position, the switch having a sidewall extending between the guide chamber and contact chamber and having a shorting bar contact on a first portion of the sidewall adjacent the contact chamber to short the switch contact ends of the first and third bus bars when the push button is pressed downwardly to an ON position, and a cam mechanism on a second portion of the side wall adjacent the latch chamber for engaging the latch mechanism to latch the push button in the ON position on a first press and unlatch the push button on a subsequent press.

6. A switch module according to claim 5 wherein the electrical fixture is a light bulb.

7. A push button switch mechanism for selectively opening and closing an electrical circuit, the switch mechanism comprising a push button and guide means for receiving the push button such that the button is linearly movable with respect to the guide means between a first and second position, the switch mechanism characterized in that;

the switch mechanism further includes first and second spring contacts disposed adjacent the guide means and electrically connectable with the circuit, the spring contacts being located in closely spaced parallel relationship to one another facing a first sidewall of the push button, the spring contacts biased in the same direction toward the first sidewall of the push button to press against a common surface of the first sidewall, the push button first sidewall having a shorting bar arranged thereon substantially flush with the common surface such that the first and second spring contacts are in electrical contact with the shorting bar when the push button is in the first position and out of electrical contact with the shorting bar and in contact with the common surface when the push button is in the second position.

8. A push button switch mechanism according to claim 7 further comprising a latching mechanism for alternatingly maintaining the push button in the first position and releasing the push button from the first position, the latching mechanism including a cam groove on the push button and a latching pin for engagement with the cam groove.

9. A switch module for selectively opening and closing an electric circuit, the module comprising:

a case having at least one molded plastic panel;

electrically conductive means within the case, the conductive means having terminal ends for connection to the circuit and first and second contact ends, the electrically conductive means being molded integrally with the panel such that the electrically conductive means is concealed within the panel with the terminal ends and the first and second contact ends protruding from the panel;

guide means disposed on the case adjacent the contact ends of the conductive means; and a push button engaged with the guide means for linear movement between first and second positions with respect to the contact ends, the push button having a shorting bar fixed thereto in a location such that the shorting bar is placed in contact with the contact ends of the conductive means to close the circuit when the push button is in the first position, and the shorting bar being removed from contact with the contact ends to open the circuit when the push button is in the second position.

10. A switch module according to claim 9 wherein an electrical component powered by the circuit is mounted to the case.

11. A switch module according to claim 9 wherein the electrical component is a light bulb.

12. The push button switch mechanism of claim 1, wherein the switch housing comprises a guide chamber defined by a sidewall open at its upper end, the sidewall further defining a contact chamber adjoining the guide chamber at a lower end of the guide chamber, the fixed contacts having free spring ends which extend from the contact chamber into the guide chamber with a lateral bias to engage the first sidewall of the switch.

13. The push button switch mechanism of claim 12, wherein the push button guide means comprises a rectangular push button guide located coaxially within the guide chamber, the push button guide including a spring seat supporting the axial spring acting against the push button.

14. A plug-in type switch module containing an electrical circuit, an electrical fixture connected to receive power from the circuit, and a push button switch mechanism for selectively closing the circuit, comprising:

an open-face plastic housing having a panel in which bus bars are insert molded to define the circuit and the electrical fixture, the bus bars being insert molded into the housing such that only the fixture, terminal plug-in ends, and switch contact ends are exposed, the housing including a hollow switch housing molded integrally with the panel, with the exposed switch contact ends of the bus bars extending through a sidewall of the hollow switch housing into a lower portion of the switch housing defining a contact chamber, the exposed switch contact ends having spring biased ends which extend into a guide chamber portion of the switch housing wherein a push button with a non-conductive sidewall having a conductive shorting bar portion moves up and down, such that the exposed switch contact ends of the bus bars maintain continuous contact with the non-conductive push button sidewall in an OFF state and slidingly engage the shorting bar portion in an ON state.

* * * * *

UNITED STATES PATENT AND TRADEMARK OFFICE

CERTIFICATE OF CORRECTION

PATENT NO. : 5,821,490

DATED : October 13, 1998

INVENTOR(S) : Michael Blossfeld

It is certified that error appears in the above-identified patent and that said Letters Patent is hereby corrected as shown below:

Column 5, line 58, delete "case" and insert --having a case--.

Signed and Sealed this

Thirteenth Day of April, 1999

*Attest:*

Q. TODD DICKINSON

*Attesting Officer*

*Acting Commissioner of Patents and Trademarks*